US006161979A

United States Patent [19]

Yamamoto et al.

[11] Patent Number: 6,161,979

[45] **Date of Patent: *Dec. 19, 2000**

[54] DUAL BINDER WITH RING BINDER COMPARTMENT AND STORAGE COMPARTMENT

[75] Inventors: Norman Yamamoto, Yorba Linda; Bruce Allen Carter, Lake Forest; Thomas M. Wien, Newport Beach, all of Calif.

[73] Assignee: Avery Dennison Corporation, Pasadena, Calif.

[ * ] Notice: This patent is subject to a terminal disclaimer.

[21] Appl. No.: 09/394,245

[22] Filed: Sep. 13, 1999

Related U.S. Application Data

[63] Continuation-in-part of application No. 09/339,150, Jun. 24, 1999, Pat. No. 6,095,564.

[51] Int. Cl.[7] ..... B42D 1/00

[52] U.S. Cl. ..... 402/73; 402/70; 281/29; 281/31; 281/36; 281/37; 281/38; 206/472

[58] Field of Search ..... 281/29, 31, 15.1, 281/28, 36, 37, 38; 402/70, 73; 190/102, 111, 115, 127, 902, 903; 206/214, 232, 472–473; 150/112

[56] References Cited

U.S. PATENT DOCUMENTS

| | | | |
|---|---|---|---|
| D. 303,548 | 9/1989 | Rexroat et al. . | |
| D. 349,514 | 8/1994 | Gotlund . | |
| 384,697 | 6/1888 | Kelly . | |
| 665,256 | 1/1901 | McComb . | |
| 676,857 | 6/1901 | White . | |
| 1,563,864 | 12/1925 | Juvet . | |
| 2,146,013 | 2/1939 | Goldblatt . | |
| 2,318,110 | 5/1943 | Sjobom . | |
| 2,318,192 | 5/1943 | Boelema, Jr. . | |
| 2,588,152 | 3/1952 | Newman . | |
| 2,636,751 | 4/1953 | Carlson . | |
| 2,716,985 | 9/1955 | Wolf . | |
| 2,742,070 | 4/1956 | Jones . | |
| 2,755,837 | 7/1956 | Kosek . | |
| 3,837,680 | 9/1974 | Cimini . | |
| 4,865,483 | 9/1989 | Snook . | |
| 4,984,924 | 1/1991 | Erlich . | |
| 5,160,001 | 11/1992 | Marceau . | |
| 5,174,674 | 12/1992 | Norwood . | |
| 5,186,565 | 2/1993 | Jack . | |
| 5,219,437 | 6/1993 | Moor et al. . | |
| 5,232,301 | 8/1993 | Bianco . | |
| 5,240,340 | 8/1993 | Lynch et al. . | |
| 5,489,021 | 2/1996 | Wallingford . | |
| 5,489,120 | 2/1996 | Thornsburg . | |
| 5,911,441 | 6/1999 | Yamamoto et al. | 281/15.1 |
| 5,916,280 | 6/1999 | Lantz | 281/29 X |

*Primary Examiner*—Willmon Fridie, Jr.
*Attorney, Agent, or Firm*—Oppenheimer Wolff & Donnelly LLP

[57] ABSTRACT

A binder assembly has a partition or intermediate panel separating a ring binder compartment from a storage compartment. The binder assembly includes a spine, a rear cover, a front cover, and an intermediate panel. The rear cover and front cover are pivotally or flexibly mounted adjacent the spine. The rear cover and intermediate panel define a ring binder space for holding pages, closed on one side where the rear and front cover are secured to the spine, and being selectively open on the other three sides. A ring binder is mounted in the ring binder space near the spine. A front cover is pivotally mounted to the intermediate panel. The intermediate panel and the front cover define a storage space closed on one side where the front cover is secured to the intermediate panel and being selectively open on the other three sides. First and second zippers extend around the three open sides of the binder and storage space, respectively, to fully enclose contents of the binder assembly.

20 Claims, 12 Drawing Sheets

FIG. 14
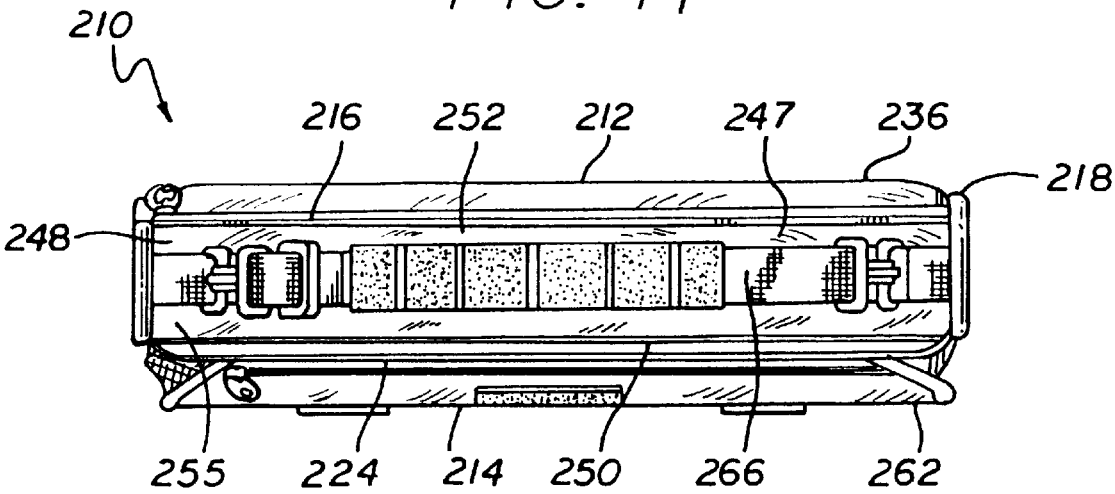
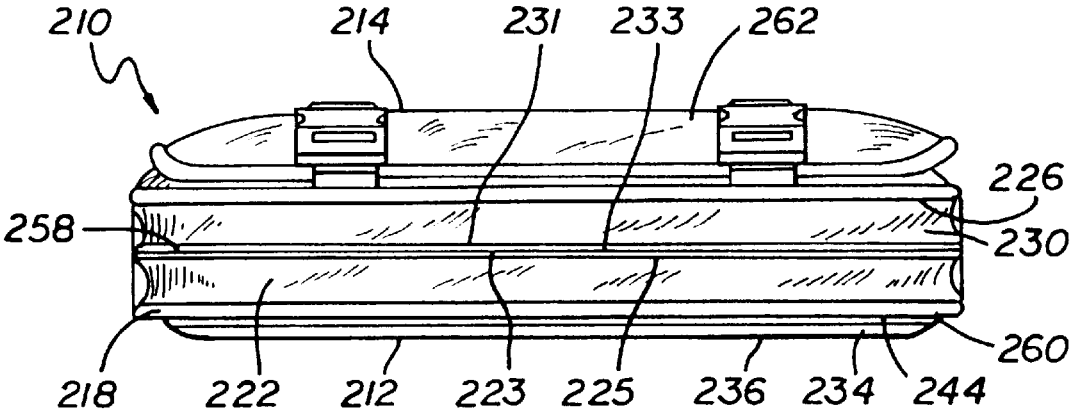
FIG. 15

DUAL BINDER WITH RING BINDER COMPARTMENT AND STORAGE COMPARTMENT

CROSS-REFERENCE TO RELATED APPLICATIONS

The present application is a continuation-in-part of Ser. No. 09/339,150, filed Jun. 24, 1999 now U.S. Pat. No. 6,095,564. Attention is also directed to U.S. Pat. No. 5,911, 441, assigned to the Assignee of this application.

FIELD OF INVENTION

This invention relates generally to a binder and, more particularly, to a versatile binder having a partition for defining a ring binder space and a storage space.

BACKGROUND OF INVENTION

Loose-leaf documents and other sheet-like elements are often bound in a supporting binder. The loose-leaf documents are easily removed, and the binder is readily reused if the contents are no longer needed. Most commonly, three ring binders are used. These binders have a spine or base hingedly connected to a front and back cover. The spine or base may be a solid backing member to which a ring assembly is secured. Alternatively, the ring assembly may be secured to one of the covers immediately adjacent to a spine. The front and back covers may be formed of a relatively flexible material, or a relatively stiff material interconnected to the spine or base through a suitable flexible connection therebetween.

Other than having interior and exterior pockets for carrying loose sheets of paper, these types of binders are not designed to carry items often carried in a briefcase or backpack such as a book, notebook, calculator, cellular phone, notebook computer, palm top computer, key chain, and office supply items such as a pen, tape, marker, ruler, and etc. To accommodate these items, students usually carry their books and other school related items to and from campus in a backpack. While on campus, students have no need for the backpack because most of the items are left in a campus locker during the school day. Usually, only a binder and several additional items are needed for a particular class, and accordingly students must either take the bulky backpack to class, or cram the needed extra items into their pockets or in the three ring binder. In another example, professionals generally carry a briefcase to and from the office but would prefer to attend meetings with only a binder and a few additional items such as a cellular phone, small calculator, and a few key papers.

Although one main purpose of such a binder is to carry papers and other items, the businessperson or student will often also use the binder to carry a fresh pad of paper on which to write information. There are carrying cases in existence which are capable of carrying papers in an organized fashion and which have space to carry a fresh notepad of paper and other items, such as pens, etc.

These carrying cases, however, have one significant drawback—the only place within the carrying case to carry the fresh pad of paper is within the central interior of the carrying case, together with the other papers and materials, which are also contained within the interior of the carrying case. Thus, in these existing carrying cases, if the user of the carrying case wishes to write something onto a fresh piece of paper contained on a notepad within the carrying case, the user will have to open the interior of the carrying case, thereby exposing the papers and other materials contained therein. By opening the interior of the carrying cease, the user runs the risk of having the papers contained within the interior of the carrying case fall out of the case, even when the user simply wants to write something down on the notepad.

Further, the writing surfaces of many desks, usually those used in a school or lecture hall, are only large enough to hold a single sheet of paper; they are not large enough to hold both sides of the carrying case when it is opened to expose the interior of the case where the user will be writing on the notepad contained inside. Thus, the user must accommodate these smaller desks while writing on the notepad contained inside the case by folding the case behind on itself, or allowing one side of the case to fall over the edge of the desk. Using these carrying cases on such smaller desks thus exposes the papers and other items contained within the case to the additional risk that the papers and other items contained within the case will fall out of the case.

SUMMARY OF INVENTION

Thus, there remains a long felt need for a relatively compact binder assembly capable of carrying loose-leaf documents and other items commonly carried in a briefcase or backpack. There also remains a need to provide a binder assembly which is aesthetically pleasing and yet rugged and mass producible at a reasonable price.

In accordance with the present invention, a partitioned binder assembly is provided which is substantially smaller than a briefcase or backpack but is capable of storing a three ring binder and other items commonly carried in a briefcase or backpack. The partitioned binder assembly includes a partition or intermediate panel separating a ring binder compartment from a storage compartment. The binder assembly includes a spine, a rear cover, a front cover, and an intermediate panel. The rear cover and the intermediate panel or partition are flexibly or pivotally mounted to the spine and define a ring binder space for holding pages. The ring binder space is closed on one side where the rear and front cover are secured to the spine and selectively open on the other three sides. A ring binder is mounted in the ring binder space near the spine.

A front cover is pivotally mounted to the intermediate panel. The front cover and the intermediate panel define a storage space for holding any desired items, such as a book, a notebook, a calculator, a pad and/or and other items. The storage space is closed on one side where the front cover is secured to the intermediate panel near the spine and is selectively open on the other three sides. First and second zippers extend around the three open sides of the ring binder space and the storage space, respectively, to fully enclose the contents of the binder assembly.

In accordance with the first embodiment of the present invention, the binder assembly may include some or all of the following features: 1) the ring binder compartment and storage compartment may be open at the same three sides, with parallel zippers extending around the three sides; 2) the storage compartment may include a file folder, a floppy disk storage arrangement, a calculator storage arrangement, writing utensil loops, and additional pocket(s); and 3) a removable ring binder member may be sized to fit into an inner pocket of the ring binder compartment.

In accordance with another aspect of the present invention, the binder assembly is capable of storing a pad of fresh writing paper in the storage compartment, which will enclose the notepad and protect it from being exposed to the outside elements. The notepad is easily accessible to the user, without having to open the ring binder compartment to expose the papers contained within the interior of the ring binder compartment of the assembly. Thus, the user may write upon the fresh paper without opening the interior of the ring binder compartment. Further, the partitioned binder assembly is sturdy enough so that the user can have a sufficiently stable surface to write upon the notepad when it is exposed from its pocket.

In one embodiment, the front cover is slightly smaller than the rear cover or the intermediate panel, reducing the extent of the storage space which still has adequate extent to accept 8½×11-inch sheets without folding.

Other objects, features, and advantages of the present invention will become apparent from a consideration of the following detailed description and from the accompanying drawings.

BRIEF DESCRIPTION OF THE DRAWINGS

FIG. 14 is a top plan view of the embodiment shown in FIG. 9; and

FIG. 15 is a bottom plan view of the embodiment shown in FIG. 9.

DETAILED DESCRIPTION OF THE PREFERRED EMBODIMENTS

Figure 1:
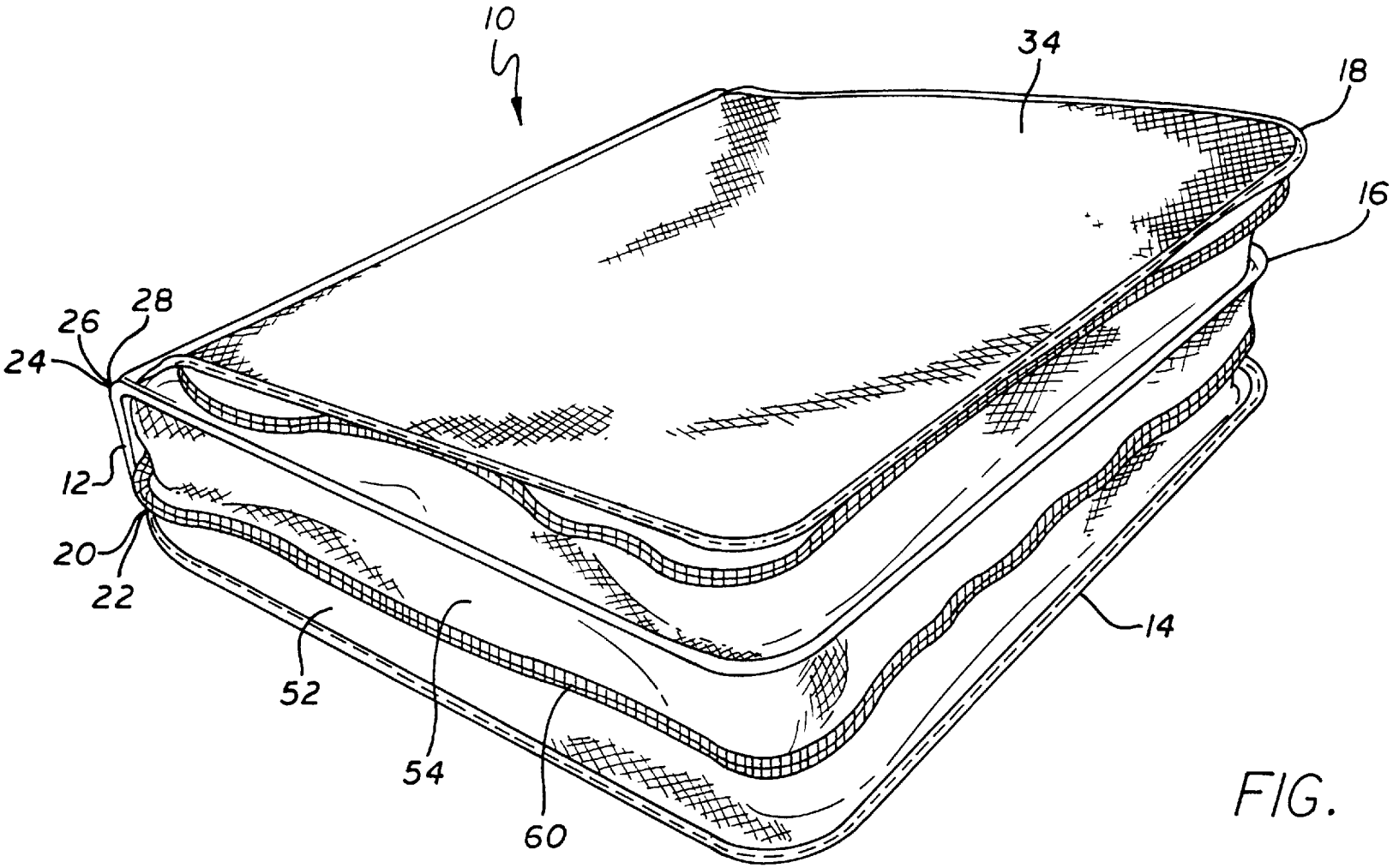
FIG. 1 is a perspective view of an embodiment of the present invention in a closed configuration.
Figure 3:
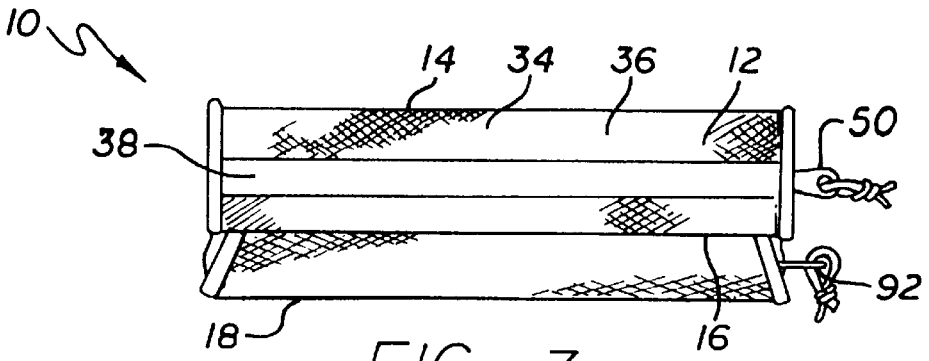
FIG. 3 is a rear view illustrating a spine of the embodiment shown in FIG. 1.
Figure 2:
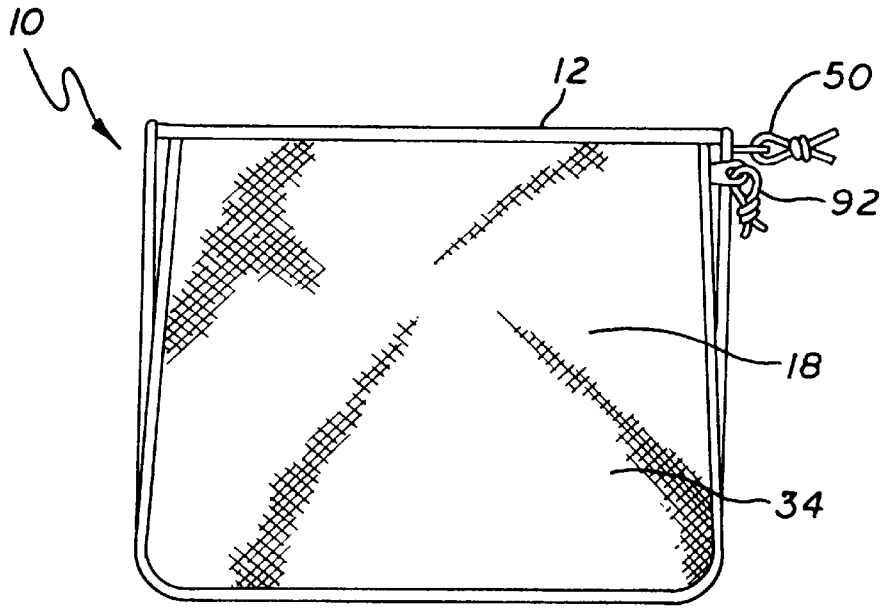
FIG. 2 is a top view of the embodiment shown in FIG. 1.
Figure 4:
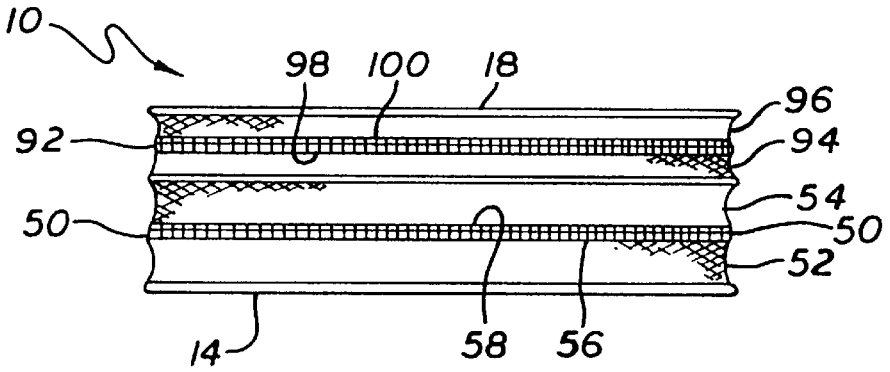
FIG. 4 is a side view illustrating the front of the embodiment with two parallel zippers, as shown in FIG. 1.
Figure 5:
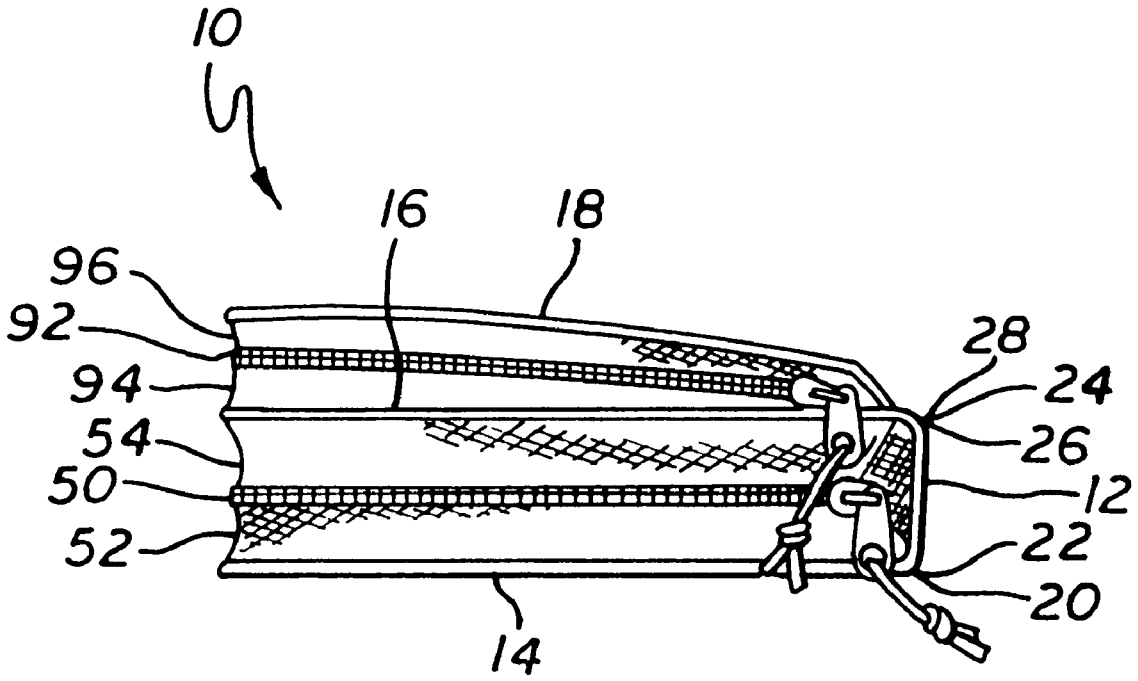
FIG. 5 is a side view illustrating the top of the embodiment shown in FIG. 1.
Figure 6:
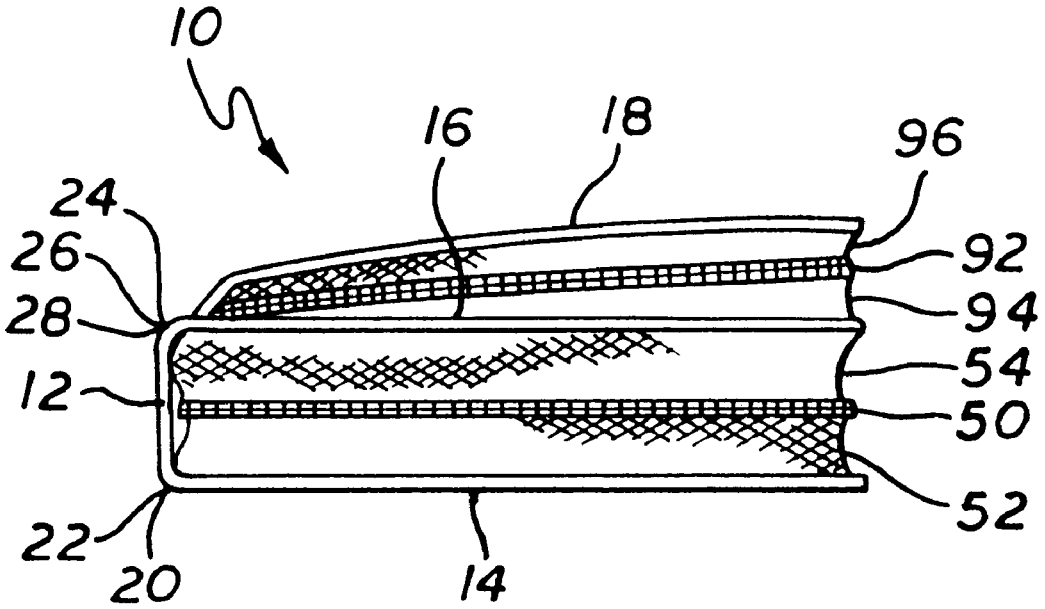
FIG. 6 is a side view illustrating the bottom of the embodiment shown in FIG. 1.

The present invention relates to a binder assembly having a ring binder compartment and a storage compartment separated by an intermediate panel. The ring binder compartment is suited to store any type of loose-leaf material. The storage compartment is suited for storing items generally carried in a briefcase or backpack such a book, notebook, calculator, and cellular phone. In the particular embodiment shown in the drawings and herein described, the binder is a three ring binder for the releasable binding of reports, records, and like assemblies of papers, films and the like. However, it should be understood that the principles of the invention are applicable to virtually any form of binder. Therefore, it is not intended to limit the principles of the present invention to the specific embodiments shown and such principles should be broadly construed.

Referring to FIGS. 1–6, a binder assembly 10 of a standard size for sheets is illustrated. Typical sheet size is A-4 size paper or paper having dimensions of 8½ by 11 inches. The binder assembly 10 includes a spine 12, a rear cover 14, an intermediate panel 16 and a front cover 18. The rear cover 14 is pivotally mounted to a rear edge 20 of the spine 12 by a first hinge 22, and the intermediate panel 16 and front cover 18 are pivotally mounted to a front edge 24 of the spine 12 by a second 26 and third hinge 28, respectively. Each of the covers 14, 18 and panel 16 has a width of about 11 inches and a length of about 12½ inches, and the spine 12 may have a width of about 2½ inches. The binder assembly 10 includes a three ring binder member 30 having rings 32 adapted to be opened for receiving 8½ by 11 inches sheet-like material having spaced holes along the inner edge for alignment with the rings 32.

Many other types of binders exist such as binders having more or less than three rings. The rings may be formed of a metal such as steel or a lightweight and inexpensive material such as a plastic. The binder assembly may also be sized to accommodate sheets larger or smaller than 8½ by 11 inches. For example, a typical carry-type organizer and calendar are usually about 5 inches by 7 inches. The present invention is intended to work equally well with these and other types of binders.

In the particular embodiment shown in the drawings and herein described, the spine 12, rear cover 14, intermediate panel 16, and front cover 18 are each formed of a relatively stiff and continuous construction. The covers 14, 18 and panel 16 each include an inner base plate (not shown) of paperboard or other suitable material. The base plates provide structural support and are relatively flexible. Each base plate extends substantially throughout the complete width and length of each of the covers 14, 18 and panel 16. A decorative and utilitarian enclosure or shell 34 is fabricated enclosing the base plates. Preferably, the shell 34 is formed from a woven fabric material which is treated with an UV resistant and water repellent coating. The fabric material may be formed from nylon, polyester, or polyvinyl chloride. An outer surface 36 of the spine 12 may further include a reflective strip 38 for safety purposes, wherein the strip 38 reflects light from a vehicle. In addition, a thin foam layer (not shown) may be provided between the inner base plates and the shell 34 to give the binder assembly 10 a softer feel and to protect the contents of the binder assembly 10.

Figure 7:
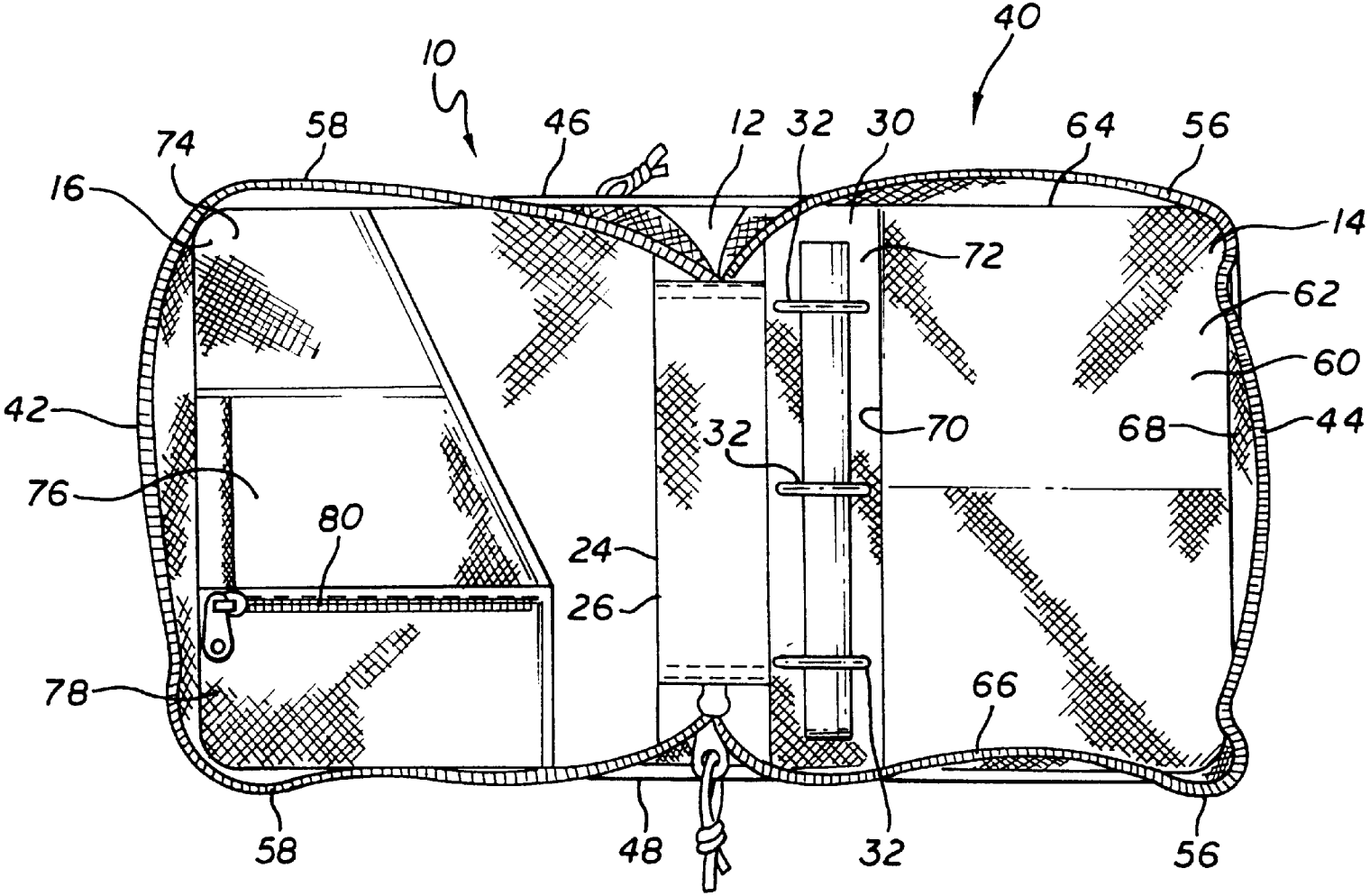
FIG. 7 is a plan view of the embodiment shown in FIG. 1 in an open configuration illustrating a ring binder compartment.

Referring to FIG. 7, the binder assembly 10 is in an open configuration to illustrate a ring binder compartment 40. In a closed configuration, the ring binder compartment 40 occupies the space between the rear cover 14 and intermediate panel 16 and extends outwardly to the outer edges of the rear cover 14 and intermediate panel 16. In an open configuration, the intermediate panel 16, spine 12, and rear cover 14 define the outer edges of the ring binder compartment 40, i.e., a front edge 42, rear edge 44, top edge 46, and bottom edge 48. The ring binder compartment 40 is selectively opened and closed by a zipper 50 connecting a first flexible sidewall 52 to a second flexible sidewall 54, wherein the zipper 50 includes a first 56 and second row 58 of interlocking tabs. One edge of the first sidewall 52 is attached to the rear cover 14, and the opposite edge of the first sidewall 52 is attached to the first row 56 of interlocking tabs. One edge of the second sidewall 54 is attached to the intermediate panel 16, and the opposite edge of the second sidewall 54 is attached to the second row 58 of interlocking tabs. The depth of the ring binder compartment 40 is about 2½ inches, which is the combined width of the first sidewall 52, zipper 50, and second sidewall 54.

With further reference to FIG. 7, the ring binder compartment 40 further includes a ring binder pocket 60 which extends from the bottom edge 48 to the top edge 46 of the rear cover 14 and from the rear edge 44 to a region near the spine 12 such that the dimensions of the ring binder pocket 60 are substantially the same as the outer dimensions of the rear cover 14. The ring binder pocket 60 comprises a pocket layer 62 with a top 64, bottom 66 and rear side 68 respectively attached to the top 46, bottom 48, and rear edge 44 of an inner surface of the rear cover 14. The side near the spine 12 is left unsecured to define a side insert opening 70. The three ring binder may be inserted into the pocket 60 through the side insert opening.

The rings 32 of the three ring binder member 30 are coupled to a base member 72 having dimensions similar to the dimensions of the ring binder pocket 40. The base member 72 may be coupled to the pocket 60 by slidingly inserting the base member 72 into the pocket 60, and the three ring binder member 30 may be decoupled from the pocket 60 by slidingly pulling the base member 72 out of the pocket 60. One of the advantages of such a configuration is that a user may easily replace one ring binder member with a set of papers to another ring binder member with another set of papers.

The ring binder compartment 40 further includes a plurality of pockets 74, 76, 78 on a surface of the intermediate panel 16. Each of the plurality of pockets comprises a pocket layer with three sides secured to the surface of the intermediate panel and a fourth side left unsecured to define an insert opening. In one of the pockets 78, the unsecured side includes a zipper 80 such that the pocket 78 may be selectively opened and closed.

Figure 8:
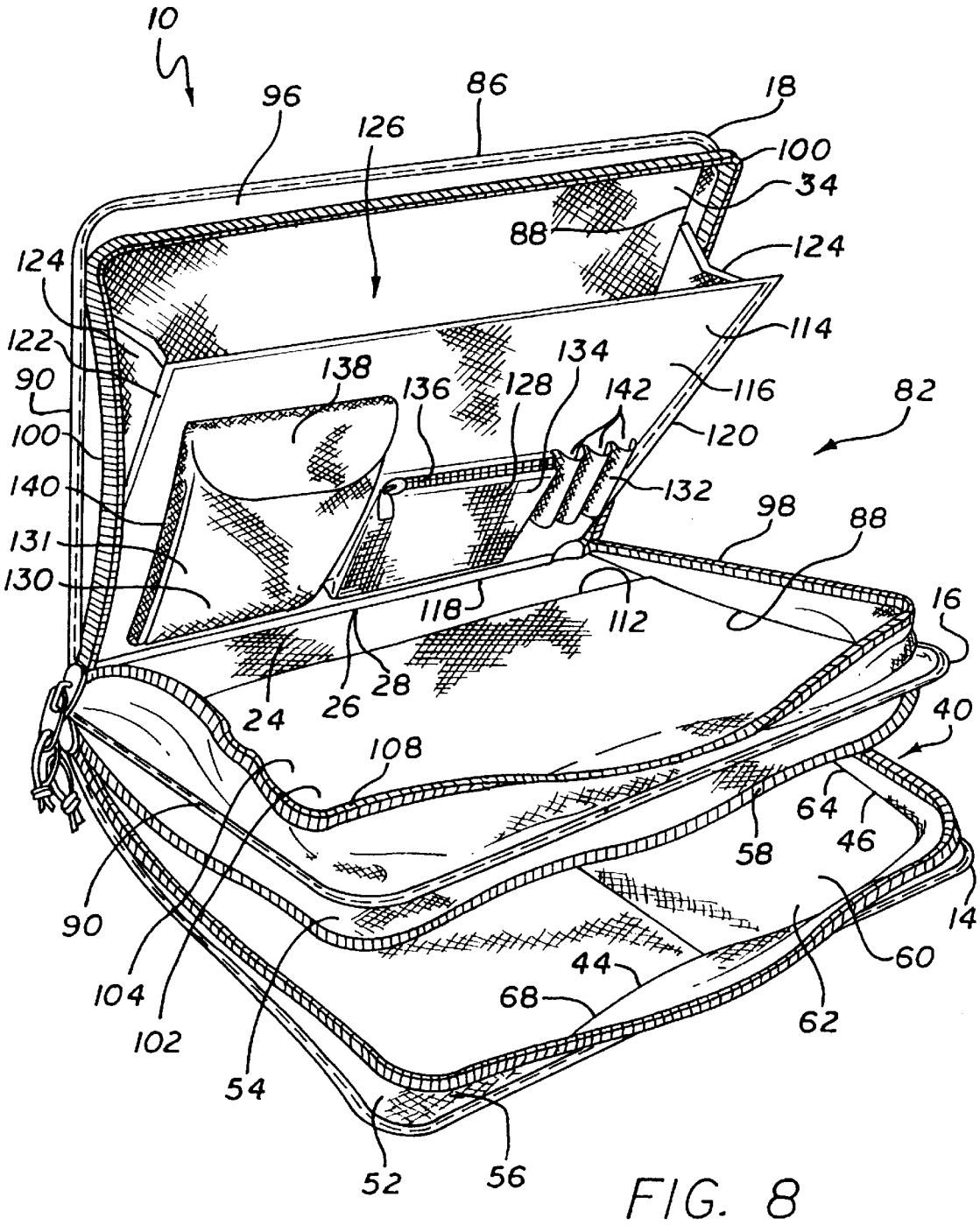
FIG. 8 is a perspective view of the embodiment shown in FIG. 1 in an open configuration illustrating a storage compartment.

Referring to FIG. 8, the binder assembly 10 is in an open configuration to illustrate a storage compartment 82. In a closed configuration, the storage compartment 82 occupies the space between the intermediate panel 16 and front cover 18 and extends outwardly to the outer edges of the intermediate panel 16 and front cover 18. In an open configuration, the front cover 18 and intermediate panel 16 define the outer edges of the storage compartment 82, i.e., a front edge 84, rear edge 86, top edge 88, and bottom edge 90. The storage compartment 82 is selectively opened and closed by a zipper 92 connecting a third sidewall 94 to a fourth sidewall 96, wherein the zipper 92 includes a third 98 and fourth row 100 of interlocking tabs. One edge of the third sidewall 94 is attached to the intermediate panel 16, and the opposite edge of the third sidewall 94 is attached to the third row 98 of interlocking tabs. One edge of the fourth sidewall 96 is attached to the front cover 18, and the opposite edge of the fourth sidewall 96 is attached to the fourth row of interlocking tabs 100. The depth of the storage compartment 82 is about 2 inches, which is the combined width of the third sidewall 94, zipper 92, and fourth sidewall 96. As discussed previously, the storage compartment 82 may be used to store a book, a notebook or palm top computer, a day planner, or any other relatively large item. That is, items which would normally be carried in a briefcase or backpack may be carried in the storage compartment 82.

With further reference to FIG. 8, the storage compartment 82, includes a pocket 102 which extends from the bottom edge 90 to the top 88 edge of the intermediate panel 16 and from the rear edge 86 to a region near the third hinge 28 such that the dimensions of the pocket 102 are substantially the same as the outer dimensions of the intermediate panel 16. The pocket 102 comprises a pocket layer 104 with a top 106, bottom 108, and rear side 110 respectively attached to the top 88, bottom 90, and rear edge 86 of the intermediate panel 16. The side near the third hinge 28 is left unsecured to define a side insert opening 112. Sheets of paper as large as 8½ by 11 inches may be inserted into the pocket 102 through the side insert opening 112.

The storage compartment 82 includes a file folder 114 attached to an inner surface of the front cover 18 and has dimensions slightly smaller than the outer dimensions of the front cover 18. The file folder 114 includes a file folder panel 116 pivotally mounted by a fourth hinge 118 which is adjacent to the third hinge 28. A top 120 and bottom side 12 of the file folder panel 116 are attached to the inner surface of the front cover 18 by flexible side extensions 124, and the side opposite the fourth hinge 118 is left unsecured to define an insert opening 126. The file folder 114 may be use to carry loose sheets of paper, spiral-bound notebook, book, or other items.

With further reference to FIG. 8, a plurality of separate storage arrangements is mounted to the file folder panel 116 such as a floppy disk storage arrangement 128, a calculator storage arrangement 130, and a writing utensil storage arrangement 132. The floppy disk storage arrangement 128 includes a meshed cover 134 closed on three sides and open on the remaining side. The three sides, which are closed, are attached to the file folder panel, and a zipper 136 is coupled to the other side to allow the arrangement to be selectively opened or closed. The calculator storage arrangement 130 includes a wall 131 having four sides. One side is pivotally mounted to the file folder panel by a hinge, while the side opposite the hinge is selectively opened and closed by a flap 138 which may be secured/unsecured to the wall by VELCRO® hook and loop material (not shown). The remaining two sides are attached to the file folder panel 116 with flexible extensions 140 which have a width of about 2 inches. It is noted that the flap 138 may be secured by other means such as a zipper, clip, or any other means known to one skilled in the art. The calculator storage arrangement 130 may be used to carry items other than a calculator such as a cellular phone, tape recorder, etc. The writing utensil storage arrangement 132 includes a plurality of loops 142 for holding writing utensils such as pencils, pens, and markers.

In another embodiment shown in FIGS. 9–18 of the drawings and herein described, the binder assembly 210 illustrating the invention comprises a first and second side panel, 212 and 214, respectively, with panel 214 also serving as the rear cover of the entire assembly. (See FIGS. 9–18.) The first side panel 212 preferably has a connecting edge 216, a side edge 218, an outer surface 220, and an inner surface 221. The side edge 218 if the first side panel 212 is preferably connected to an outer side wall 222. Likewise, the second side panel 214 preferably has a connecting edge 224, a side edge 226, an outer surface 228, and an inner surface 229. The side edge 226 of the second side panel 214 is preferably connected to an outer side wall 230. The first and second side panels, 212 and 214, are preferably rectangularly-shaped and are preferably of the same size. The first and second side panels are preferably of a size that is greater than 8.5 inches by 11 inches so that papers of that size may be easily accommodated within the interior of the binder assembly.

The first and second side panels, 212 and 214, are preferably formed from a cardboard or chipboard or other lightweight, sturdy material. The first and second side panels, however, may be formed from any material that is sturdy and is lightweight, as is well-known by those of skill in the art. The panels should be sturdy and strong enough to protect the papers that will be contained within the binder assembly, and should be sturdy enough to provide a suitable writing surface.

The cardboard or other material of the first and second panels, 212 and 214, are also preferably covered in their entirety on their outer surfaces, 220 and 228, and inner surfaces, 221 and 229, with a fabric covering. The fabric is preferably a thick, strong canvas material, which will protect the panels and the papers that are contained within the binder assembly from the outside elements, while providing a pleasing, aesthetic look to the binder assembly. Again, the fabric material covering the panels may be any lightweight natural or synthetic fabric that is capable of protecting the panels and the papers contained within the binder assembly, as is well-known to those of skill in the art.

The binder assembly 210 includes an interior 246 for carrying papers. (See FIG. 16). The interior is formed by the first panel, the second panel, and a third or middle panel 248. The third or middle panel 248 has a first and second connecting edge, 250 and 252, respectively. The connecting edge 216 of the first side panel 212 is connected to the first connecting edge 250 of the middle panel or spine 248 and the connecting edge 224 of the second panel 214 is connected to the second connecting edge 252 of the middle panel or spine 248. Thus, the connection of the first and second panels, 212 and 214, to the middle panel 248 forms the interior 246 and exterior 247 of the binder assembly.

The middle panel or spine 248 is also preferably formed from a cardboard, chipboard or other lightweight material, as with the first and second panels, as described above. The middle panel or spine 248 may be formed from any material that is sturdy and is lightweight, as is well-known by those of skill in the art. The middle panel is sturdy and strong enough to protect the papers and provide a backbone for the binder assembly. The cardboard or other material of the middle panel also preferably covered in their entirety with a fabric covering, as with the first and second panels, as described above.

The connection of the first panel 212 to the middle panel or spine 248 and the connection of the second panel 214 to the middle panel 248 preferably permits the first and second panels to be moved relative to the middle panel. The fabric that forms the outer surface of the first, second, and middle panels, 220, 228 and 255, respectively, and the fabric which forms the inner surface of the first, second, and middle panels, 221, 229 and 254, respectively, are stitched together in the space between the cardboard of the first panel 212 and the cardboard of the middle panel 248 and in the space between the cardboard of the second panel 214 and the cardboard of the middle panel 248. Thus, this configuration permits the first and second panels, 212 and 214, to be moved relative to the middle panel 248 and thereby expose the interior 246 of the binder assembly to permit the user of the binder assembly to have access to the papers contained within the interior and to permit the user to open the binder assembly onto a flat surface such as a desk so that the exterior of the binder assembly lays flat on the flat surface.

The middle panel has an inside surface 254. There is preferably a three ring binder 256 attached by rivets to the inside surface of the middle panel 254. The three-ring binder is used to hold papers within the interior 246 of the binder assembly. These papers preferably have three holes punched along one edge so that they may be held within the interior of the binder assembly. Instead of a three-ring binder on the inside surface 254 of the middle panel 48, there may also be any other type of binder for holding papers, as is well-known to those of skill in the art.

The first panel 212 is preferably selectively sealable by a sealing element 258 to the second panel 214 in order to enclose the interior 246 of the binder assembly 210 and to permit the binder assembly to be moved from an opened position to a closed position and vice versa. (See FIGS. 9, 11, 12, and 16). As discussed above, the side edge 218 of the first side panel 212 is connected to an outer side wall 222 and the side edge 226 of the second side panel 214 is connected to an outer side wall 230. The outer side walls 222 and 230 of the first and second side panels 212 and 214 each have an outer edge, 223 and 231, respectively. The sealing element 258 is preferably a zipper wherein the outer edge of each has one corresponding side of a zipper, 225 and 233 attached thereto. The side of the zipper 225 of the outer side wall 222 of the first side panel 212 is engaged to the side of the zipper 233 of the outer side wall 230 of the second side panel 214 when the case 210 is in its closed position. (See FIGS. 9, 11 and 12.) Thus, when the zipper, 225 and 233, is engaged, the binder assembly is in its closed position and the papers are safely contained within its interior, while the first pocket containing the notepad is located on the outer surface of the first panel, as will be described below. The binder assembly 210 is moved to its opened position (See FIG. 16) when the user disengages the zipper, 225 and 233, connecting the outer side walls, 222 and 230, of the first and second side panels, 212 and 214, thereby permitting the first and second side panels to be moved relative to the middle panel 248, as described above.

The outer side walls, 222 and 230, of the first and second side panels, 212 and 214, are preferably formed from the same fabric material as is used to form the outer and inner surfaces of the first, second, and middle panels of the binder assembly. The width of each of the outer side walls, 222 and 230, is equal to approximately one of the width of the middle panel 248, so that, when the binder assembly 210 is in its closed position, the width of the surface formed by the outer side walls is approximately the same as the width of the middle panel. (See FIGS. 11 and 12).

The first panel 212 preferably has an outer surface 220. (See FIGS. 13 and 17). There is preferably a first pocket 234 attached to the outer surface 220 of the first side panel 212, with the pocket 234 forming a front cover of the entire assembly. The first pocket 234 is preferably formed from a flap of fabric 236 that is sewn or otherwise attached to the fabric of the outer surface 234 of the first panel 212, adjacent to and pivotally or flexibly connected near the spine or middle panel 248. The fabric flap 236 of the first pocket 234 is preferably formed from the same strong, lightweight canvas used to cover the interior cardboard of the panel 212. This fabric is also preferably substantially waterproof to protect the notepad that will be stored within the first pocket 234. The first pocket 234 also serves as the front cover of the entire assembly.

The first pocket 234 is preferably adapted to fit a notepad. (See FIG. 17). The notepad 235 preferably has sheets of 8.5 inches by 11 inches paper 237 contained thereon and has a cardboard or other stiff material backing (not shown). Thus, the flap of fabric that forms the first pocket is preferably rectangularly-shaped with one of its longer edges being attached to the outside surface of the first panel. The first pocket 34 and the fabric flap preferably have a width that is greater than 8.5 inches and a length that is greater than 11 inches to be able to hold such a notepad 235.

The sheets of paper are preferably attached at their top edge to the backing of the notepad. (See FIG. 17). The notepad may, however, be any type of similar notepad of any size and shape such that the first pocket is adapted to fit such notepad within it.

The first pocket 234 preferably contains a second pocket 238 within the first pocket 234. The second pocket 238 is preferably another piece 240 of the same fabric that is sewn to the fabric of the outer surface 232 of the first panel 212. The fabric 240 of the second pocket 238 is preferably shaped to be adapted to contain the backing of a pad of paper. Thus, the second pocket 238 and the fabric forming the second pocket 240 are preferably rectangularly-shaped. The fabric 240 is preferably slightly shorter in length than the length of the notepad 235 and is sewn or otherwise attached to the fabric of the outer surface 220 of the first panel 212 along three of its sides, so that the backing of the notepad may be inserted within the second pocket.

The first pocket 234 is preferably selectively moveable from an opened position to a closed position by a sealing element 260. (Compare FIGS. 13 and 17). The sealing element 260 is preferably a zipper 244 wherein the fabric flap 236 of the first pocket 234 of the first side panel 212 has an outer edge 242, the outer edge having one side of a zipper 244 attached thereto and wherein the outer surface 228 of the first side panel 212 has the corresponding side of the zipper 244 attached thereto. The one half of the zipper 244 of the outer edge 242 of the first pocket 234 corresponds to and selectively attaches to the one half of the zipper 244 attached to the outer surface 232 of the first side panel 212. Thus, when the first pocket 234 is in its closed position (See FIG. 13), the two halves of the zipper 244 are attached, thereby providing an interior space for storing the notepad, which is substantially impermeable to the elements.

The first pocket 234 provides the benefits of holding a fresh pad of paper 237 within the binder assembly 210, but in such a manner that the user does not have to open the interior 246 of the binder assembly 210, thereby exposing the papers contained therein to the outside elements and to the possibility of being lost from the interior of the binder assembly, in order to write information onto the fresh pad of paper. Further, because the user does not have to open the interior of the binder assembly in order to expose the fresh writing, pad, the user can use the first side panel as a writing surface. The first side panel, being formed from sturdy cardboard provides a sturdy writing surface. Moreover, the user can write on the fresh pad of paper on a small surface such as a small desk in a lecture hall, without having to fold back or otherwise accommodate the two side panels of the binder assembly.

The pocket 234 could also accommodate other objects such as a magazine, brochure or other materials to which quick access is desired. Writing materials such as pencils or pens and a ruler could be readily accommodated within the pocket 234, and the clips on a pen could be hooked onto the edge of pocket 240 to hold them in place.

Figure 9:
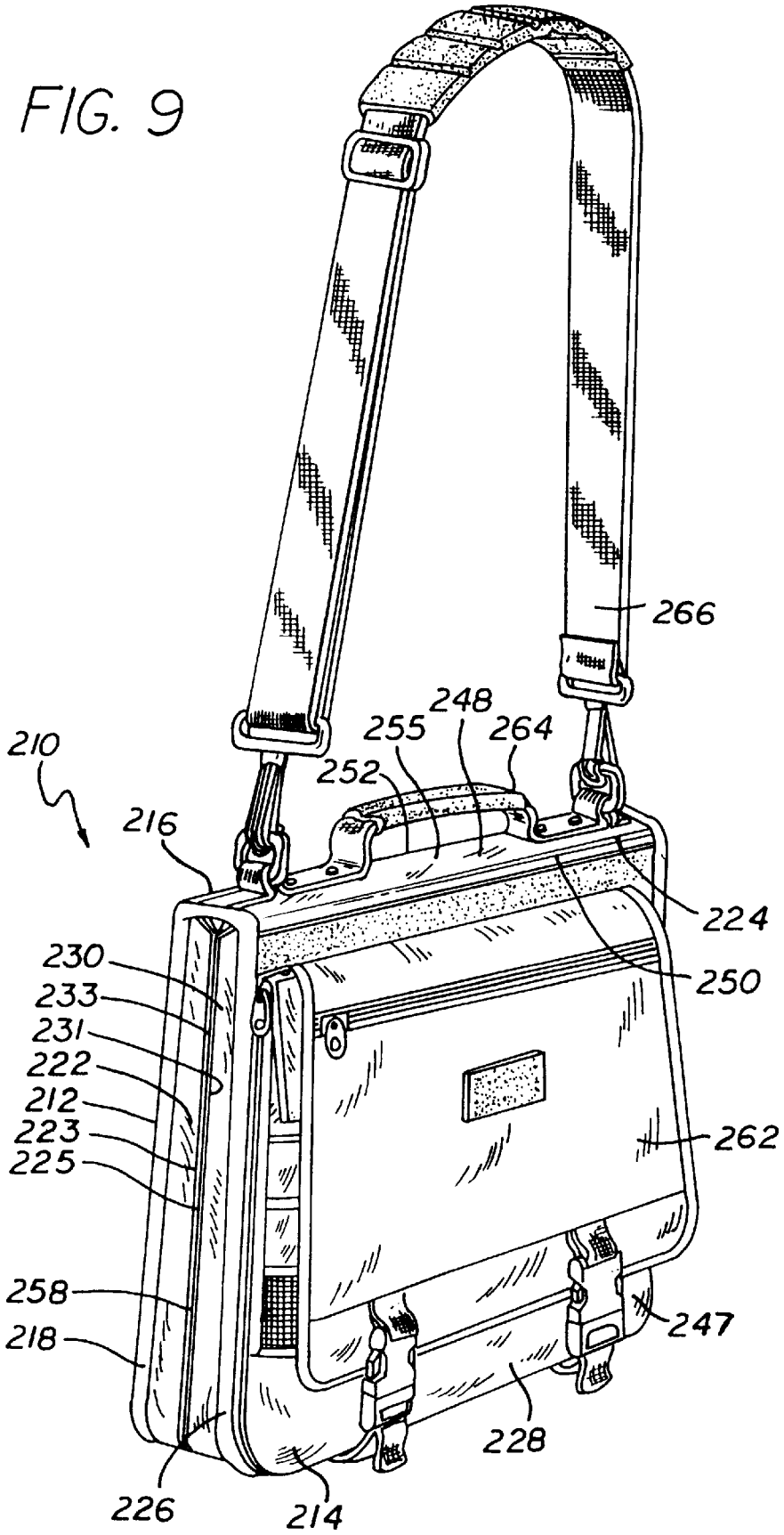
FIG. 9 is a front, side perspective view of another embodiment made in accordance with the present invention.
Figure 10:
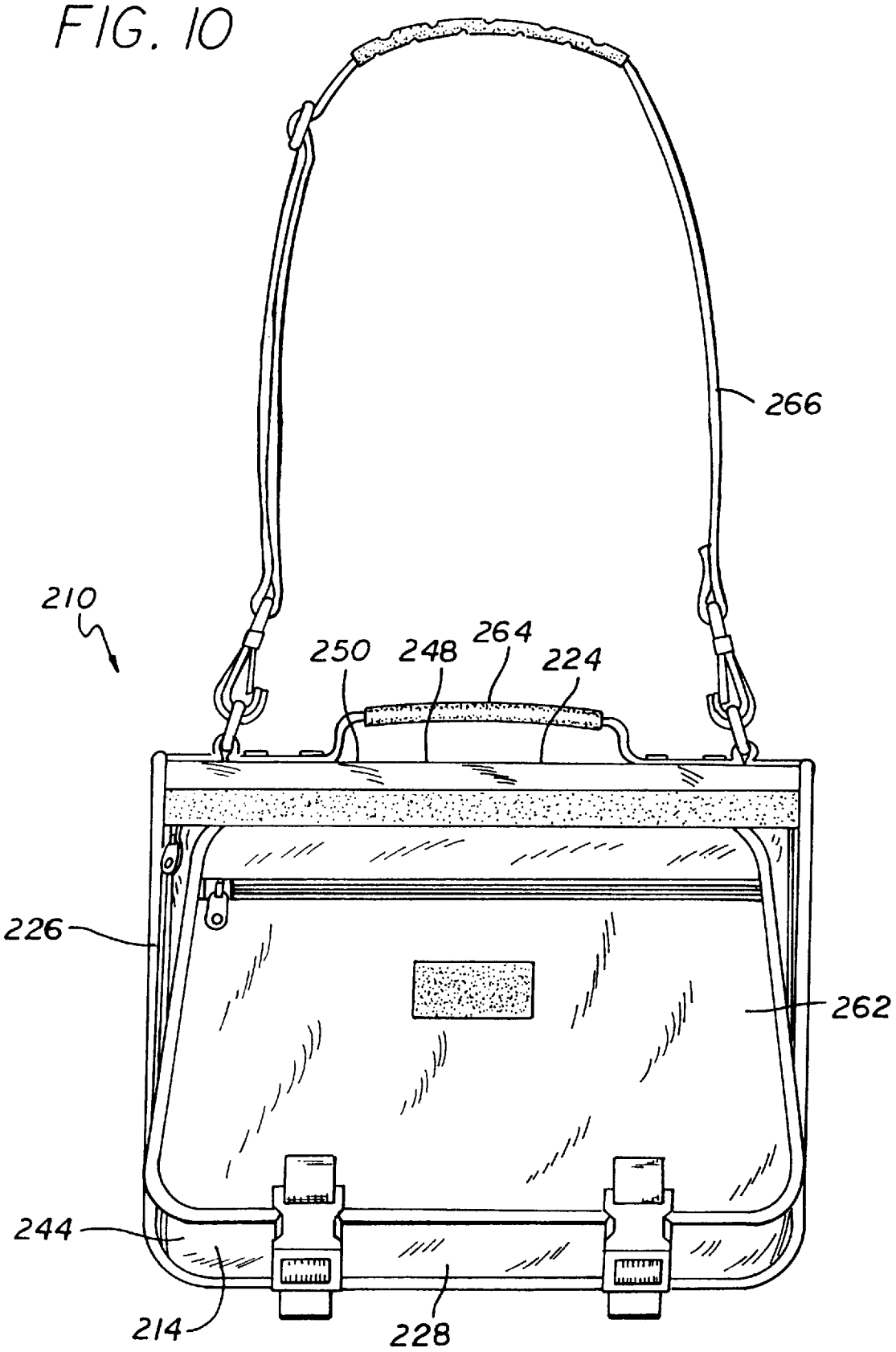
FIG. 10 is a front elevational view of the embodiment shown in FIG. 9.
Figure 11:
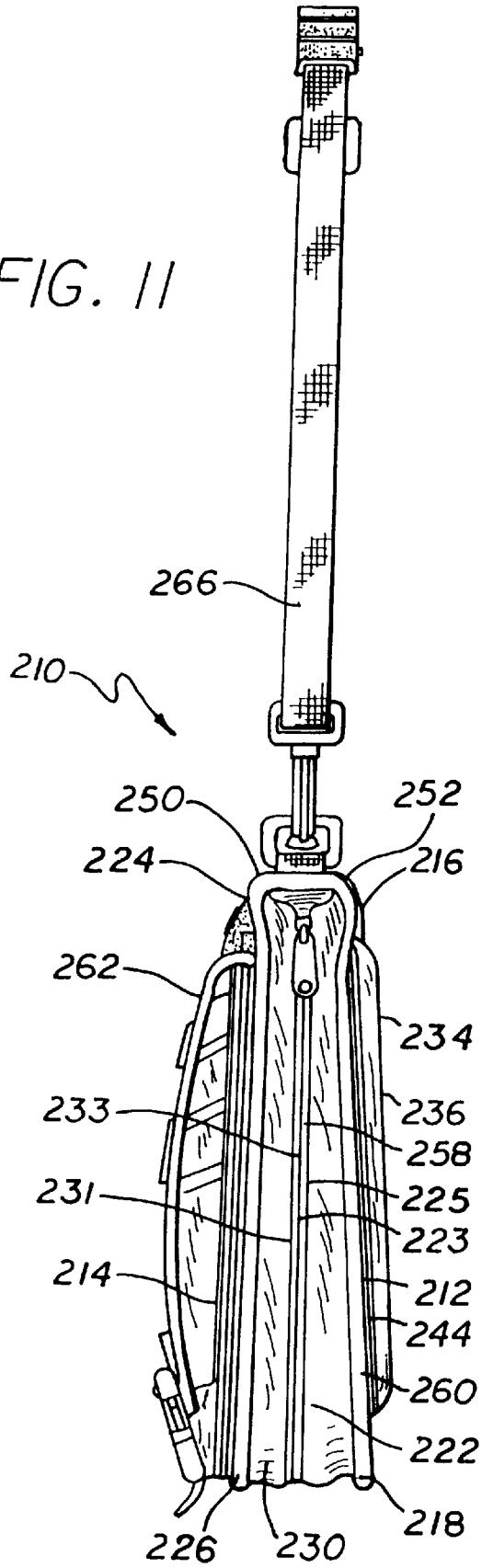
FIG. 11 is a left side view of the embodiment shown in FIG. 9.
Figure 18:
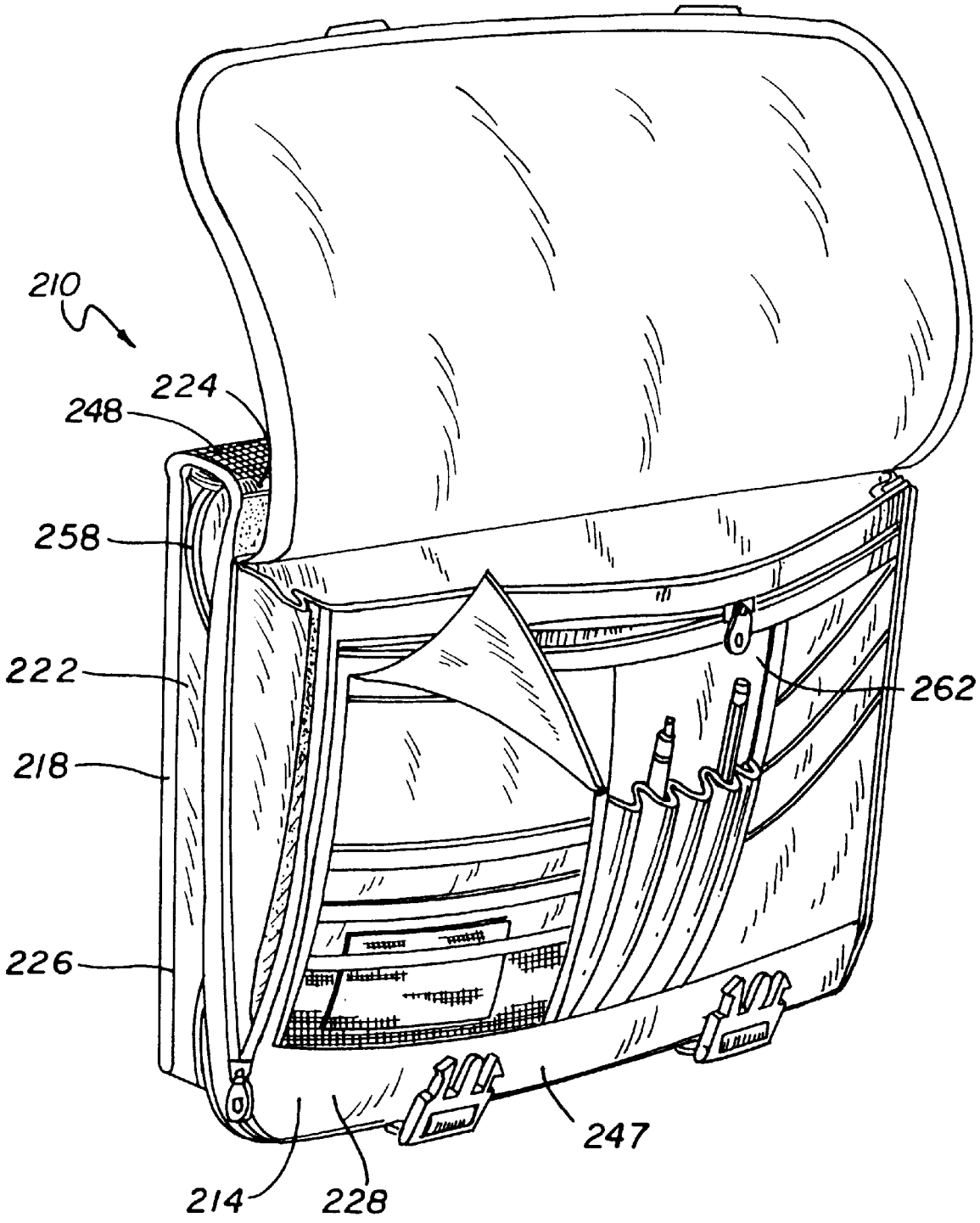
FIG. 18 is an elevational view showing the side flap of the embodiment shown in FIG. 9 in its opened position.

The binder assembly may further include additional pockets 262 on the outer surface of the second side panel. (See FIGS. 9, 10, and 18). The pockets shown in FIGS. 9, 10, and 18 are exemplary of the pockets that may be included on the outer surface of the outer side panel. These additional pockets may be pockets for holding pens and pencils, calculators, business cards, and other such items. Any configuration, size and placement of pockets on the outer surface of the second side panel are within the scope of the invention.

The binder assembly may further include a carrying handle 264 and shoulder strap 266 attached to the outer surface of the middle panel. (See FIGS. 9–14). The carrying handle 264 allows the user to carry the binder assembly 210 by hand, while the shoulder strap 266 allows the user to carry the binder assembly over his shoulder. The length of the shoulder strap 266 may be adjustable. The carrying handle 264 and shoulder strap 266 shown in FIGS. 9–14 are merely exemplary—any carrying handle and shoulder strap are within the scope of the invention.

While a particular form of the invention has been illustrated and described, it will be apparent that various modifications can be made without departing from the scope of the invention. For instance, the size and shape of the first, second and middle panels, 212, 214, and 248, may differ depending on the size and shape of the papers to be placed within the interior of the case and the size and shape of the notepad 236 to be placed in the first pocket. Further, the materials used to form the first, second, and middle panels, 212, 214, and 248, may differ depending on the intended use of the binder assembly. For instance, the panels may be formed from plastic and the panels may be connected by a hinge-type mechanism. Moreover, the binder assembly may contain additional pockets within its interior and on its exterior, including a pocket within the first pocket that holds a pen and another pocket which holds a calculator so that the user has only to open the first pocket to have access to paper, pen, and a calculator. In addition, for example, the cover 236 may be selectively held in its closed configuration by Velcro®-type hook and loop pads or strips, instead of the zipper 260. Also, instead of a second pocket 238, the pad 235 may be held in place by clips or by a transverse strip or strips for receiving the backing of the pad or extending over the pad. Accordingly, it is not intended that the invention be limited by the specific embodiment disclosed in the drawings and described in detail hereinabove.

Figure 12:
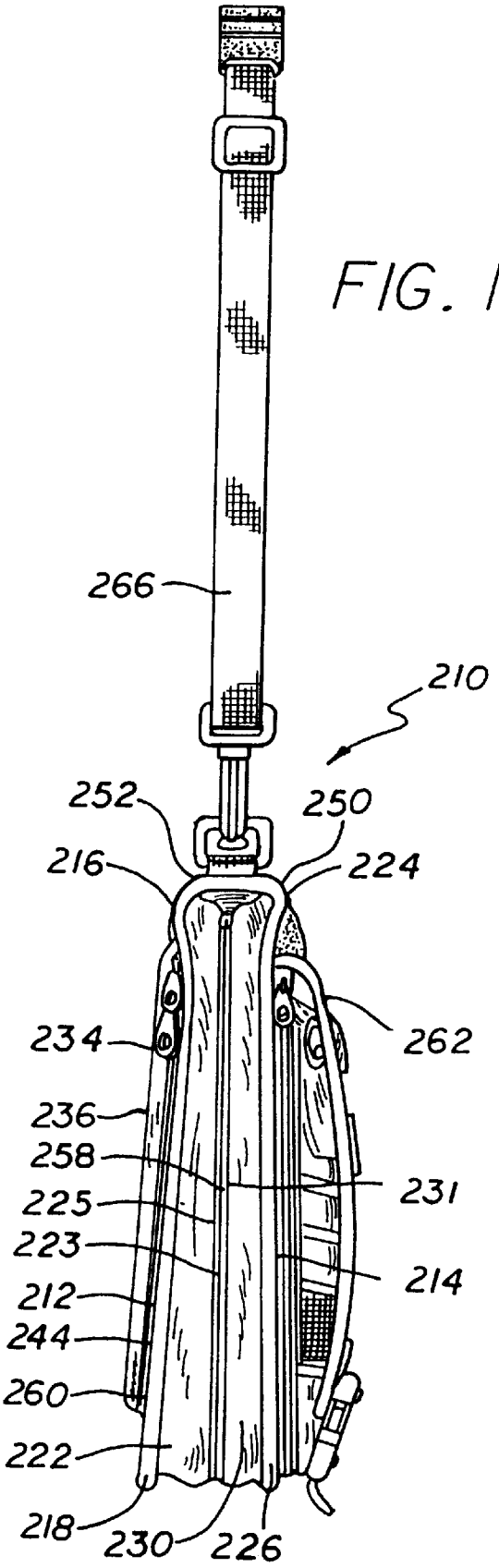
FIG. 12 is a right side view of the embodiment shown in FIG. 9.
Figure 13:
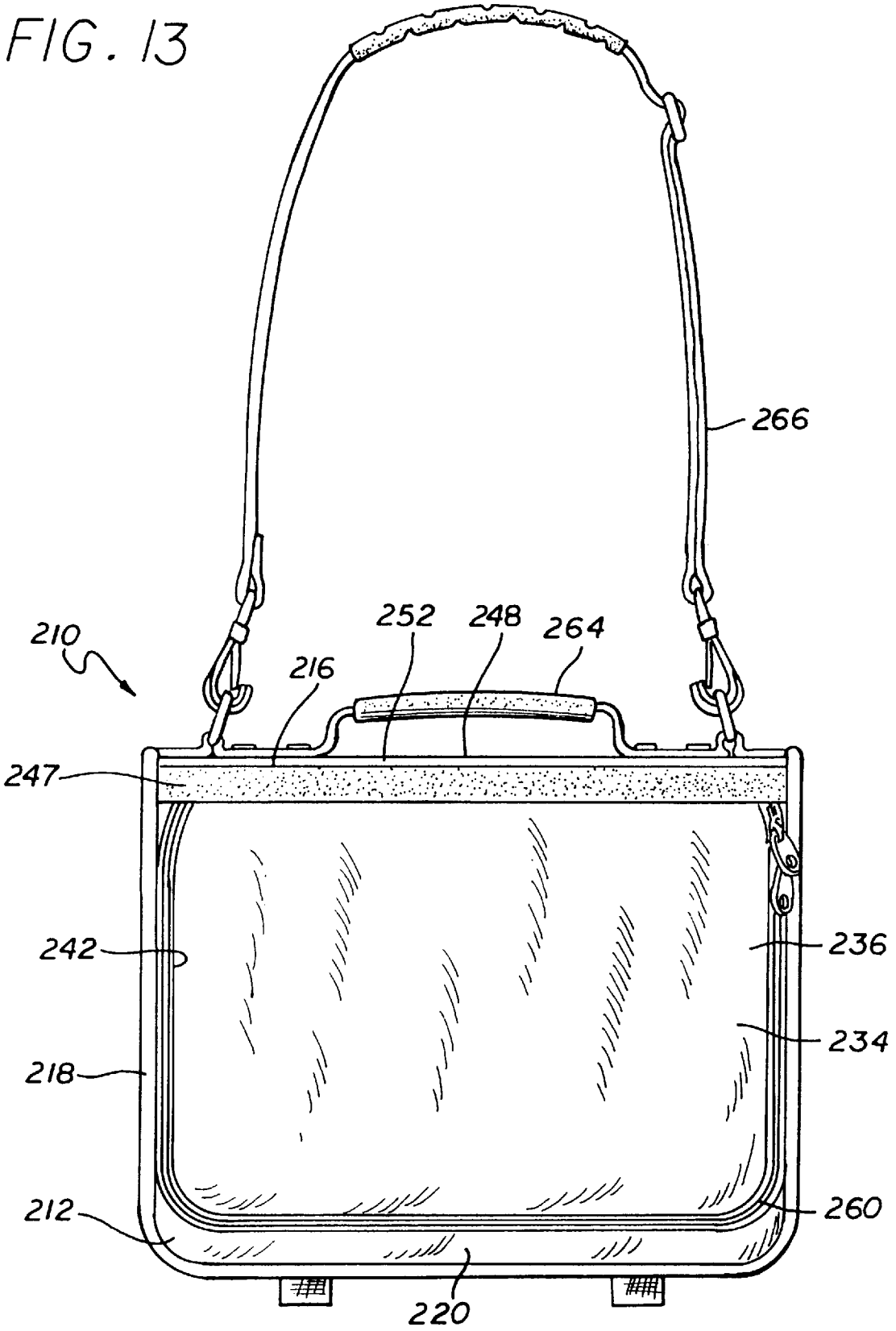
FIG. 13 is a rear elevational view of the embodiment shown in FIG. 9.
Figure 16:
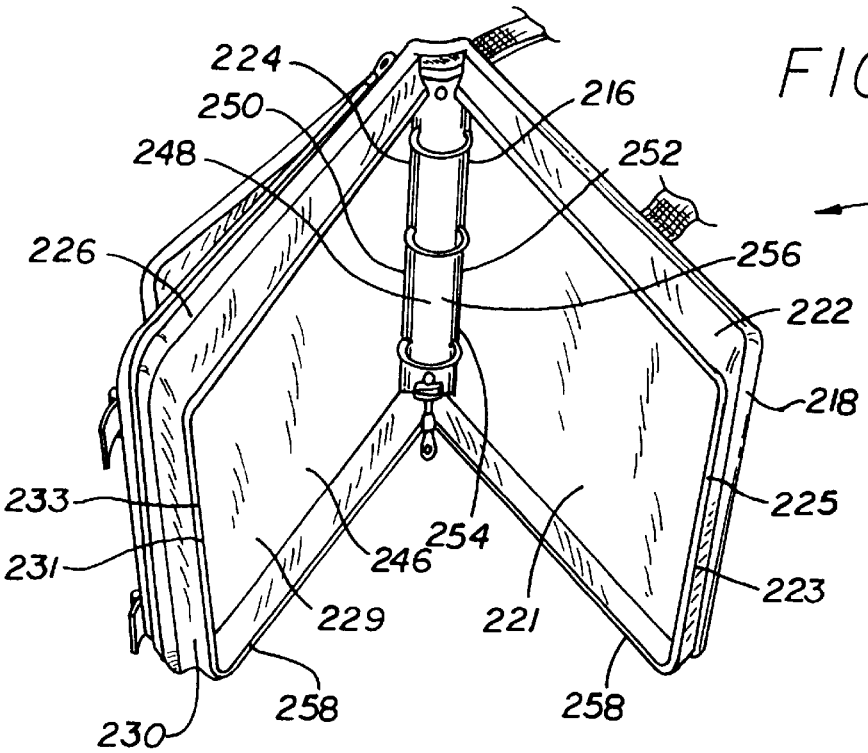
FIG. 16 is an elevational view showing the interior of the embodiment shown in FIG. 9 when the embodiment is in its opened position.
Figure 17:
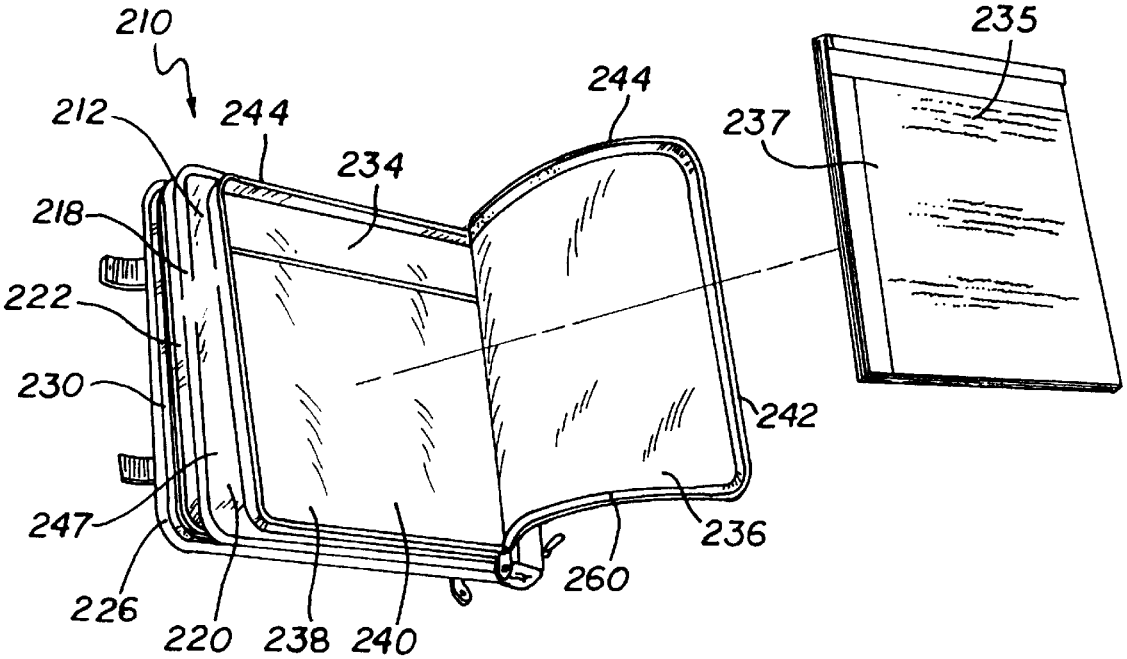
FIG. 17 is an elevational view showing the notepad and showing the notepad within the first pocket of the embodiment shown in FIG. 9.

It is noted in passing that the binder assembly of FIGS. 9–18 has a central three ring binder section with panels 212 and 214 on either side of the binder section. As viewed from the perspective of FIG. 13, the fabric 236 serves as the front cover of the entire binder assembly, and the panel 214 is the rear or back cover of the assembly with an optional outer pocket secured thereto. As shown in FIG. 12, for example, the panel 212 is an intermediate panel between the back cover 214 and the front cover 236.

Although the present invention has been described in detail with regarding the exemplary embodiment and drawing thereof, it should be apparent to those skilled in the art that various adaptations may be accomplished without departing from the spirit and scope of the invention. For instance, the binder assembly of FIGS. 1–8 may further include a second or more storage compartments. Further, the storage compartment may be selectively opened and closed by other means such as a strap and clip arrangement. It is also noted that the three open sides of the ring binder compartment and/or the storage compartment may be held closed by strips of hook and loop material in whole or in part or by any other suitable closures instead of by zippers. Still further, the storage compartment may have outer dimension substantially smaller than the outer dimensions of the ring binder compartment, wherein a hinge for the front cover is located on the central portion of the intermediate panel. The hinge for the storage compartment may be located on a side opposite the hinge for the ring binder compartment. Accordingly, the invention is not limited to the precise embodiment shown in the drawings and described in detail hereinabove.

What is claimed is:

1. A partitioned binder assembly comprising:

a spine;

a rear cover, an intermediate panel and a front cover, each being pivotally or flexibly mounted adjacent to said spine;

said rear cover and said intermediate panel defining a ring binder space for holding pages, closed on one side where the rear cover and panel are secured to the spine, and being selectively open on the other three sides;

said intermediate panel and said front cover defining a storage space closed on one side where said panel and said front cover are secured to said spine, and being selectively open on the other three sides;

a ring binder mounted in said ring binder space near said spine;

said ring binder being dimensioned to receive sheet material having a width of about 8½ inches and a length of about 11 inches; and said ring binder having rings adapted to be opened to receive and to remove sheet material, and adapted to be closed to hold sheet material;

at least one storage arrangement including a pocket mounted to said assembly within said storage space;

first and second zippers extending around the three open sides of said binder space and said storage space, respectively, to fully enclose the contents of said binder assembly;

the distance between said front cover and said intermediate panel being substantially less than the distance between said back cover and said intermediate panel when said first and second zippers are closed; and said rear cover and said intermediate panel being of relatively stiff or semi-rigid material.

2. A partitioned binder assembly as defined in claim 1 wherein said front cover is slightly smaller in area than said intermediate panel, thereby forming a storage space which is somewhat less in extent than said ring binder space, but which will accept 8½×11-inch sheets without folding.

3. An assembly as defined in claim 1, wherein each of said rear and said front covers have an outer surface, said outer surfaces lying on a flat plane when said ring binder space is in an open position to allow viewing of sheets of loose-leaf material bound in said ring binder.

4. The assembly of claim 1, wherein said rear panel and said intermediate panel each include a base plate covered on both sides with a woven fabric material.

5. The assembly of claim 1, wherein said rear cover and said intermediate panel have a width of at least 11 inches and a length of more than 12 inches.

6. The assembly of claim 5, wherein said ring binder is dimensioned to receive sheet material having a width of about 8½ inches and a length of about 11 inches.

7. The assembly of claim 1, wherein said ring binder has rings adapted to be opened for receiving sheet material having spaced holes along an inner edge for alignment with said rings.

8. The assembly of claim 1, further comprising:

a pocket on an inner surface of said rear cover;

said ring binder including a base member and rings coupled to said base member, said rings adapted to be opened for receiving sheet material having spaced holes along an inner edge for alignment with said rings; and said pocket slidingly receiving said base member such that said ring binder may be easily removed and inserted.

9. An assembly as defined in claim 1 wherein said storage space includes arrangements for holding writing materials firmly in place.

10. An assembly as defined in claim 1 further comprising an additional storage compartment secured to said rear cover.

11. The assembly of claim 1, wherein said at least one storage arrangements comprise:

a file folder including a wall pivotally connected to said front cover by a hinge on one side and by flexible extensions on two adjacent sides;

a storage arrangement adapted to receive floppy disks, said storage arrangement including a meshed cover closed on three sides and being selectively opened and closed on the other side, said three sides being attached to said pocket wall, and a third zipper extending along the other side to fully enclose said storage arrangement; and a calculator storage arrangement including a calculator wall closed on three sides and being selectively open on the other side, said three sides attached to said pocket wall, and a flap extending over the other side to fully enclose said calculator storage arrangement; and at least one loop attached to said pocket wall for holding one or more writing utensils.

12. The assembly of claim 1 wherein said at least one storage arrangement includes:

a second pocket mounted in said storage space;

said second pocket including a storage assembly having a meshed cover closed on three sides and being selectively opened and closed on the other side, and a third zipper extending along the other side of said meshed cover to fully enclose said storage assembly; and at least one loop attached to said storage space for holding one or more writing utensils within said storage space.

13. A binder assembly comprising:

a spine;

a front cover, a rear cover and an intermediate panel, each being pivotally or flexibly mounted to said spine;

said rear cover and said intermediate panel defining a ring binder space for holding pages, closed on one side where said rear and said front cover are secured to said spine, and being selectively open on the other three sides;

a ring binder mounted in said ring binder space near said spine;

said front cover and said intermediate panel defining a storage space closed on one side where said front cover is secured to said intermediate panel, and being selectively open on the other three sides; and first and second closures extending around the three open sides of said binder space and said storage space, respectively, to enclose the contents of said binder assembly.

14. The assembly of claim 13, further comprising a plurality of separate storage arrangements mounted to said assembly in said storage space.

15. The assembly of claim 13, wherein each of said cover and said intermediate panel includes a base plate covered on both sides with a woven fabric material.

16. A partitioned binder assembly comprising:

a spine;

a rear cover, an intermediate panel and a front cover, each being pivotally or flexibly mounted to said spine;

said rear cover and said intermediate panel defining a ring binder space for holding pages, closed on one side where said rear cover and said panel are secured to said spine, and being selectively open on the other three sides;

said intermediate panel and said front cover defining a storage space closed on one side where said panel and said front cover are secured to said spine, and being selectively open on the other three sides;

a ring binder removably mounted in said ring binder space near said spine; and first and second closure arrangements extending around the three open sides of said binder space and said storage space, respectively, to fully enclose the contents of said binder assembly.

17. The assembly of claim 16, further comprising:

a pocket on an inner surface of said rear cover;

said ring binder including a base member and rings coupled to said base member, said rings adapted to be opened for receiving sheet material having spaced holes along an inner edge for alignment with said rings; and said pocket slidingly receiving said base member such that said ring binder may be readily removed and inserted.

18. The assembly of claim 16, further comprising a plurality of storage arrangements on an inner surface of said storage space, said plurality of storage arrangements including a floppy disk storage arrangement, a calculator storage arrangement, and a writing utensil storage arrangement.

19. A partitioned binder assembly comprising:

a spine;

a rear cover, an intermediate panel and a front cover, each being pivotally or flexibly mounted to said spine;

said rear cover and said intermediate panel defining a ring binder space for holding pages, closed on one side where the rear cover and panel are secured to the spine, and being selectively open on the other three sides;

said intermediate panel and said front cover defining a storage space closed on one side where said panel and said front cover are secured to said spine, and being selectively open on the other three sides;

at least one storage arrangement mounted to said assembly in said storage space;

said storage space having a pocket therein; and first and second zippers extending around the three open sides of said binder space and said storage space, respectively, to fully enclose the contents of said binder assembly.

20. The assembly as defined in claim 19 wherein said storage space has an extent adequate to hold 8½×11-inch papers unfolded, and wherein said storage space is lesser in extent and depth than said binder space.

* * * * *